United States Patent [19]

Rommel

[11] Patent Number: 4,700,592

[45] Date of Patent: Oct. 20, 1987

[54] TOOL FOR CRIMPING, CUTTING, PRESSING OR THE LIKE

[76] Inventor: Reiner Rommel, Moldaustrasse 6, 3570 Stadt Allendorf, Fed. Rep. of Germany

[21] Appl. No.: 898,344

[22] Filed: Aug. 20, 1986

Related U.S. Application Data

[63] Continuation of Ser. No. 716,645, Mar. 27, 1985.

[30] Foreign Application Priority Data

Mar. 28, 1984 [DE] Fed. Rep. of Germany ..... 3411397

[51] Int. Cl.[4] ..... B25B 7/12

[52] U.S. Cl. ..... 81/355; 81/361; 81/362

[58] Field of Search ..... 81/355, 361, 362; 72/410; 29/751

[56] References Cited

U.S. PATENT DOCUMENTS 3,688,553 9/1972 Demler ..... 81/355

3,751,963 8/1973 Munshower et al. ..... 81/355

4,055,980 11/1977 Churla ..... 72/410

*Primary Examiner*—Frederick R. Schmidt

*Assistant Examiner*—Maurina Rachuba

*Attorney, Agent, or Firm*—Thomas & Kennedy

[57] ABSTRACT

The invention relates to a tool for crimping, cutting, pressing or the like having a linear work path and a lever drive engaged between the gripping levers and the tool head, with two cover plates (1), each of which form an integrally enclosed frame and which are firmly connected to one another by an intermediately located, upper profile plate (2), and a lower profile plate (3) which can be moved up and down by the lever drive and is guided between the two cover plates (1) by a guide plate (16) being superimposed on the profile plate (3), which guide plate (16) extends into the frame (1), with the upper and lower profile plates (1,2), on the sides facing one another, forming or supporting tools which effect the crimping, cutting, pressing or the like.

8 Claims, 7 Drawing Figures

TOOL FOR CRIMPING, CUTTING, PRESSING OR THE LIKE

This is a continuation of co-pending application Ser. No. 716,645 filed Mar. 27, 1985.

FIELD OF THE INVENTION

The invention relates to a tool for crimping, cutting, pressing or the like having a linear work path and a lever drive engaged between the gripping levers and the tool head, which, by means of the gripping levers, which are to be pressed together, enables a considerable pressure to be exerted on the tools effecting the crimping, cutting, pressing or the like.

BACKGROUND OF THE INVENTION

A drawback of the previous crimping cutting and pressing tools is that their manufacture is associated with considerable difficulties, because the individual tool parts have to work with the greatest precision for the workpieces to be really connected or formed as desired.

The object of the invention is to create such a tool which, by the most simple manufacture, enables the greatest precision to be achieved in use.

This is achieved according to the invention by two cover plates, each of which form an integrally enclosed frame and which are firmly connected to one another by an intermediately located, upper profile plate, and a lower profile plate which can be moved up and down by the lever drive and is guided between the two cover plates by a guide plate being superimposed on the profile plate, which guide plate extends into the frame, with the upper and lower profile plates, on the sides facing one another, forming or supporting tools which effect the crimping, cutting, pressing or the like.

The tool head is preferably formed in a sandwichtype construction from superimposed, flat frame parts and plates.

A further advantage, which considerably increases the application possibilities of the tool, is provided in that the tool head can be detached from the gripping levers and exchanged for other tool heads for other work possibilities.

It is of very special importance, however, that a positive lock which can be set to the respective final pressure required for the tools is engaged between the gripping levers, which positive lock prevents the tool from opening before this final pressure is reached. This ensure that each workpiece is formed at the required pressure and a reject through improper treatment is avoided. The positive lock is expediently formed from an adjustable ratchet, the pawl of which sits on a gripping lever and interacts with a toothed segment provided on the other gripping lever, with the pawl and toothed segment being mutually adjustable to control the opening time. After an operation has been started, the tool according to the invention cannot be opened again until the required final pressure is reached.

BRIEF DESCRIPTION OF THE DRAWINGS

The idea behind the invention permits the most varied embodiment possibilities. One of them is shown in the attached drawing, wherein.

DETAILED DESCRIPTION

Figure 1:
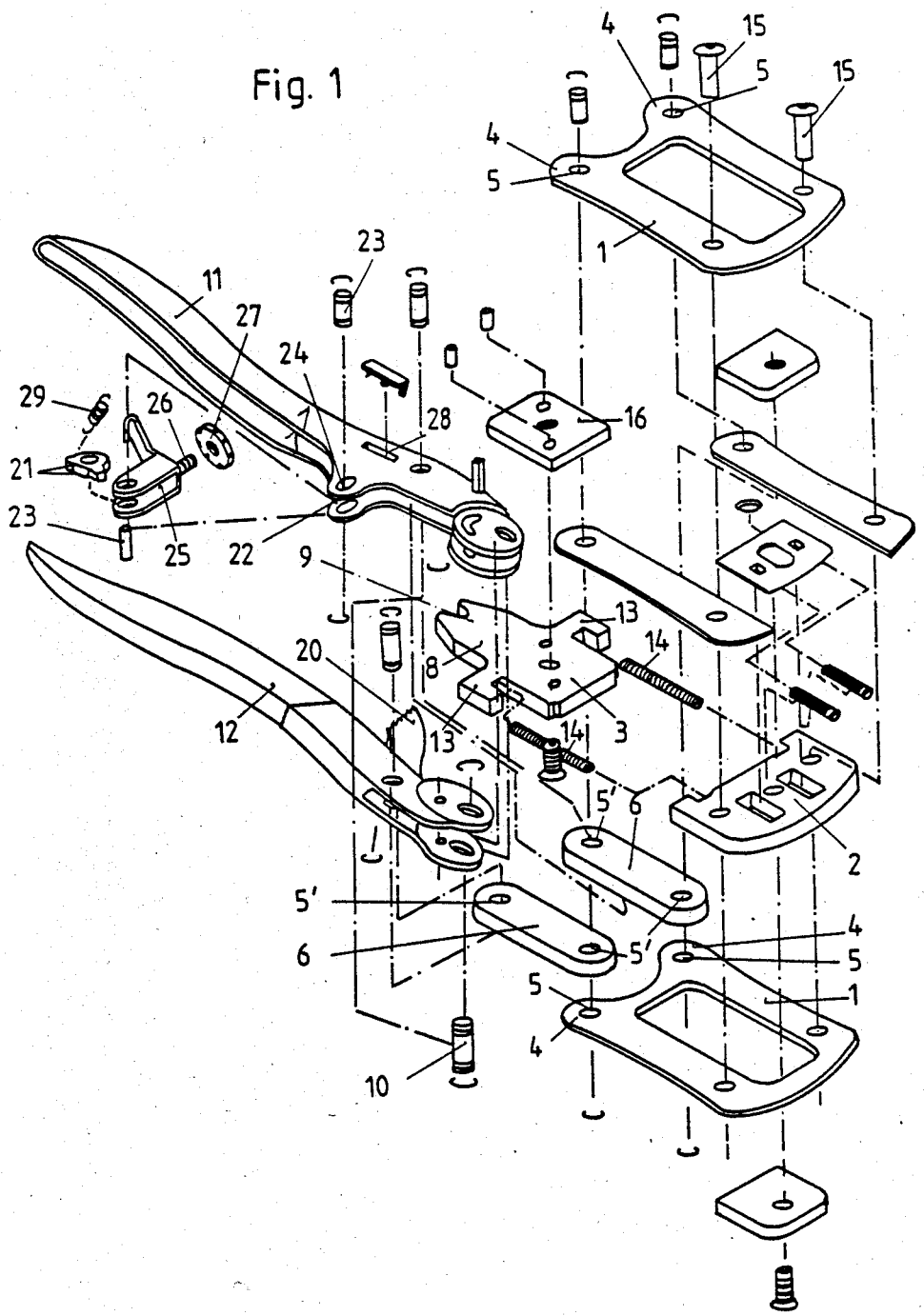
FIG. 1 shows an exploded view of the complete tool.
Figure 2:
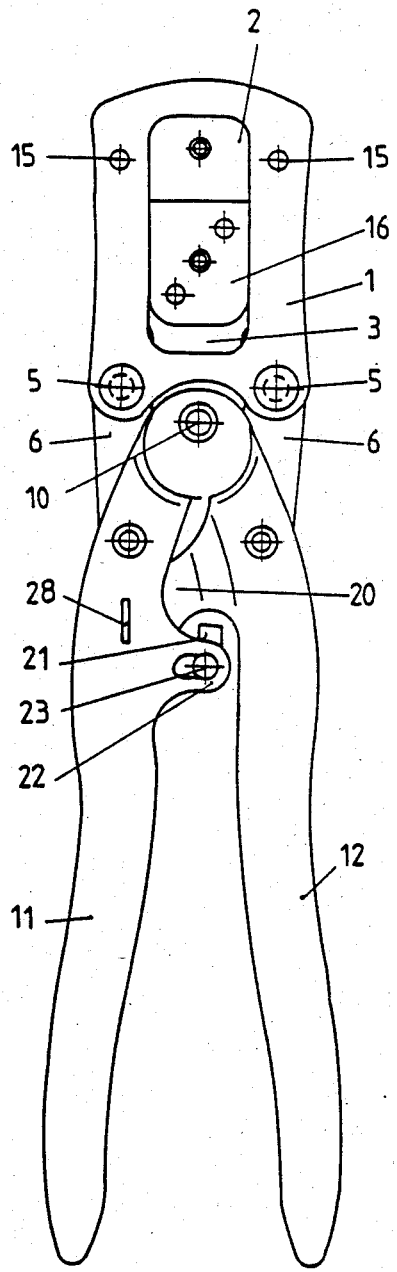
FIG. 2 shows a side view of the tool in the closed position.
Figure 6:
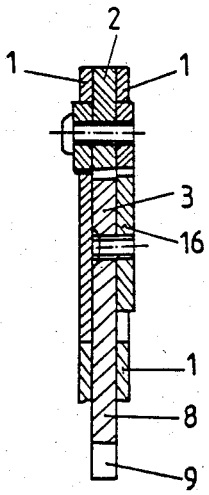
FIG. 6 shows a section through a part of the tool head.

The complete tool consists of the details shown in the exploded view according to FIG. 1 and is essentially formed from a tool head K which is interchangeably connected to a gripping lever drive G. In a sandwich-type construction, the tool head consists of flat, punched-out plates 1 which, under the interposition of a plate 12, are connected to one another by screws or rivets 15 in such a way that they sit free at their ends facing towards the gripping levers G and form a space in which a slide plate 3 can be displaced up and down, which slide plate 3 forms the lower crimping plate and interacts with the intermediate plate 2, which represents the upper crimping plate.

Holes 5 are provided in downwardly extending projections 4 of the plates 1 in order to attach intermediate levers 6 for connecting the tool head to the gripping levers. The connection is effected by guide pins or screws 7 which are inserted in the holes 5 provided for this purpose of the plates 1 or 5' of the intermediate levers 6 and are only removed for exchanging the tool head.

Figure 3:
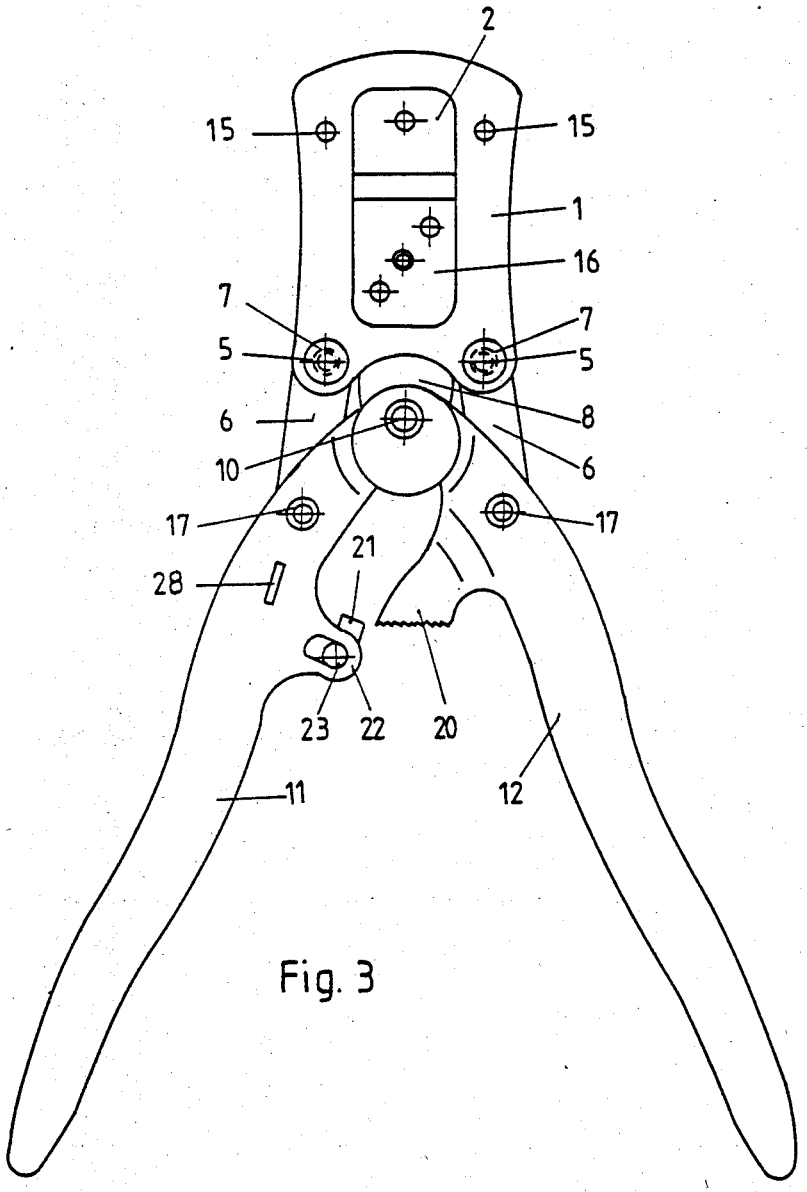
FIG. 3 shows a side view of the opened tool.
Figure 4:
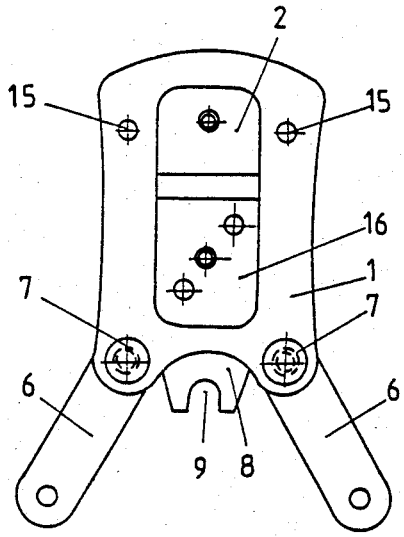
FIG. 4 shows the tool head after separation from the gripping levers.
Figure 5:
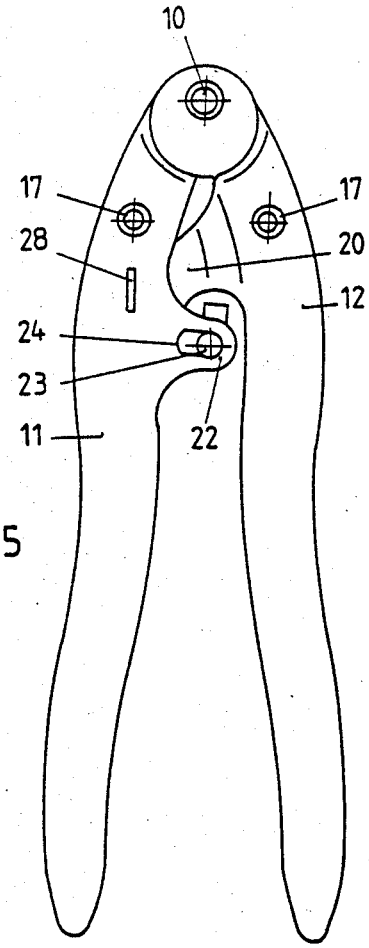
FIG. 5 shows the gripping levers after removal from the tool head.
Figure 7:
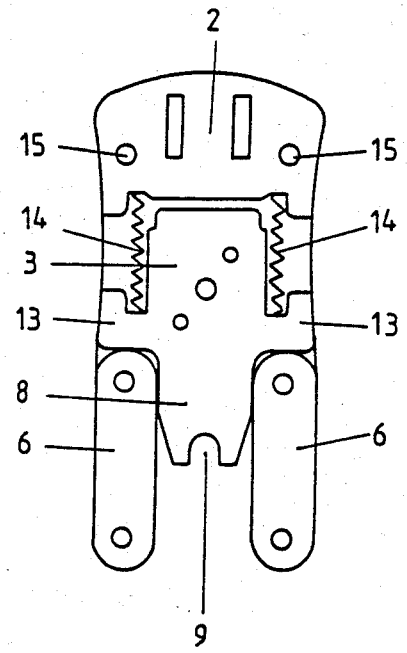
FIG. 7 shows a plan view of the tool head with the cover plate removed.

The slide plate 3 has a prolongation 8 which extends downwards beyond the plates 1, which prolongation 8 has a groove 9 by means of which it is supported on the link pin 10 of the gripping levers 11 and 12 to be described below. Moreover, spring abutments 13 are provided on both sides of the plate 3 for compression springs 14 which are inserted between the plate 3 and plate 2, which compression springs 14 press the two crimping tools 2 and 3 into their open position according to FIG. 3 when the gripping levers 11 and 12 are spread apart. The plate 3 is guided by an attachment 16 which slides in the inner space of the upper cover plate 1.

The lower crimping plate 3 is a moved with respect to upper crimping plate 2 by opening and closing the gripping levers 11 and 12. Moreover, the two intermediate levers 6 are pivoted on the link pins 17 of the two gripping levers.

The lever drive 6 connects the tool head K and the gripping lever drive G in such a way that, when the gripping levers 11 and 12 are spread apart via the levers 6, the lower tool 3 is removed from the upper tool 2, and when the gripping levers 11 and 12 are closed, their link pin 10 moves upwards and the two crimping tools 2 and 3 are moved towards one another and the pressing operation, that is, crimping of the workpiece inserted between the two tools 2 and 3, takes place. By slackening the pine 7 or 17, the entire tool head K can be removed from the gripping lever drive G and exchanged for another tool set.

Since it is important that a certain final pressure is always reached when crimping the workpiece, the gripping lever drive G must be prevented from reopening before this final pressure is reached. This is down by a so-called positive lock which allows the gripping levers 11 and 12 to reopen only after this final pressure is reached. A toothed segment 20 is provided for this purpose on the inside of one gripping lever 12, whereas on the other gripping lever 11 a pawl 21 is mounted on a pin 23 in a mounting 22. As shown, the mounting hole 24 provided in the mounting is slotted, so that the mounting pin 23 can be displaced in this hole. This displacement is effected by a mounting yoke 25 in which a threaded pin 26 is provided on which an adjusting nut 27 is screwed on. This is guided in a slot 28 provided in the lever 11 and, when it is actuated, causes the mounting pin 23 to slide backwards and forwards in its mounted position 24. By shifting the adjusting nut 27, the pawl 21, which is under the effect of a tension spring 29, is displaced in the toothed segment 20, by which means the time of reopening of the two gripping levers 11 and 12 is prevented and thus adaptation to the respective final pressure required during crimping results.

It will be understood by those skilled in the art that the embodiment of the invention disclosed herein achieved the desired objectives; however, various modifications of the disclosed embodiment can be made without departing from the scope of the invention as set forth in the following claims.

I claim:

1. A tool for crimping, cutting, pressing or the like having a linear work path and including a pair of gripping levers (11, 12) each pivotably connected at one end to the other by a link pin (10) and a tool head (K) mounted to the levers at their pivoted ends and a pair of lever drive members (6, 6) engaged between the gripping levers and the tool head, said tool head including two cover plates (1) is spaced parallel relationship which together form a integrally enclosed frame and which are firmly connected to one another by an intermediately located upper profile plate (2), at least one of said cover plates defining an elongated guide opening therethrough of a predetermined length extending between said upper profile plate (2) and said link pin (10) and of a predetermined width, and a lower profile plate (3) positioned between said cover plates including an open groove (9) facing said link pin, spring means (14) mounted in said tool head and urging the groove of said lower profile plate into engagement with said link pin a guide plate (16) attached to said lower profile plate and protruding into the elongated guide opening of one of said cover plates, said guide plate (16) being of a length extending along said elongated guide opening which is shorter than the length of said elongated guide opening so that the guide plate 916) and lower profile plate (3) are movable along the length of the guide opening, said guide plate being of a width approximately the same as the width of the elongated guide opening so that the guide plate (16) and guide opening maintain the lower profile plate in a nonrotatable attitude, whereby the lower profile plate can be moved up and down by the pivotable movement of the lever drive members (6) and is guided between the two cover plate (1) by the guide opening of the guide plate (16), with the upper and lower profile plates (2,3), on the sides facing one another, forming tool elements which effect the crimping, cutting, pressing or the like, and tool head (K) can be detached from the gripping levers (11, 12) and exchanged for other tool head forms (K) without detaching the gripping levers from each other.

2. The tool according to claim 1, wherein the tool head (K) is formed in a sandwich-type construction from superimposed, flat frame parts and plates (1, 2, 3).

3. The tool according to claim 1, wherein a positive lock (20 to 29) is mounted on said gripping levers and is constructed so that it can be set to determine the final position required between the gripping levers, which positive lock (20 to 29) prevents the tool from opening before the final position is reached.

4. The tool according to claim 3, wherein the positive lock (20 to 29) is formed from an adjustable ratchet, the pawl (21) of which is mounted on a gripping lever (11) and interacts with a toothed segment (20) mounted on the other gripping lever (12), with the pawl (21) and the toothed segment (20) being mutually adjustable to control the opening position of the gripping levers.

5. The tool according to claim 1, wherein the upper and lower profile plates (2, 3) are each equipped with several working profiles which are to be used alternately.

6. A tool for crimping, cutting, pressing or the like including a pair of gripping levers each pivotably connected at one end to the other with a link pin and a tool head removably mounted to said gripping levers at the pivoted ends of said gripping levers, said tool head including a pair of intermediate levers each pivotably connected at one end to one of said gripping levers at position displaced from said link pin, the improvement therein of said tool head assembly including a pair of cover plates positioned in overlying relationship, an intermediate profile plate positioned between said cover plates and maintaining said cover plates in parallel spaced relationship, a slide plate positioned adjacent said link pin between said cover plates, said slide plate including a groove facing away from said profile plate for straddling said link pin, spring means positioned between said cover plates at opposite sides of said slide plate for urging said slide plate away from said intermediate profile plate and urging the groove of said slide plate toward engagement with said link pin, at least one of said cover plates defining a rectilinear guide opening extending between said intermediate profile plate and said link pin, said slide plate including a protrusion mounted thereon which protrudes through said guide opening, said protrusion being of a width approximately the same as the width of said guide opening and of a length less than the length of said guide opening and of shape which limits the movement of the slide plate to directions extending along the length of the rectilinear guide opening toward and away from the intermediate profile plate and prevents the slide plate from rotating or moving out from between the cover plates, and said intermediate levers each connected at their other ends at opposite sides of said slide plate to said cover plates, whereby when the gripping levers are pivoted toward each other the intermediate levers pull the cover plates and intermediate profile plate toward the link pin and the link pin urges the slide plate toward the intermediate profile plate against the bias of said spring means.

7. The tool of claim 6 and wherein the guide opening of said cover plate is of a predetermined length extending between said link pin and said intermediate profile plate and of a predetermined width, and wherein the protrusion mounted on said slide plate comprises an attachment plate of a width approximately the same as the width of said guide opening and of a length less than the length of said guide opening whereby the attachment plate limits the movement of the slide plate to directions extending along the length of the cover plate toward and away from the intermediate profile plate and prevents the slide plate from moving out from between the cover plates when the tool head is detached from the gripping levers.

8. The tool of claim 6 and wherein said spring means comprises coil compression springs positioned between said pair of cover plates at opposite sides of said slide plate and bearing against said slide plate and said intermediate profile plate to continuously urge said slide plate away from said intermediate profile plate and toward said lock pin.

* * * * *